US005853224A

United States Patent [19]

Riese

[11] Patent Number: 5,853,224

[45] Date of Patent: Dec. 29, 1998

[54] METHOD FOR COMPLETING A WELL IN A COAL FORMATION

[75] Inventor: Walter C Riese, Katy, Tex.

[73] Assignee: Vastar Resources, Inc., Houston, Tex.

[21] Appl. No.: 787,458

[22] Filed: Jan. 22, 1997

[51] Int. Cl.[6] ..... F21B 43/263; F21C 37/14

[52] U.S. Cl. ..... 299/13; 166/299; 299/16

[58] Field of Search ..... 299/13, 16; 175/4.57, 175/4.6; 166/299, 297, 308

[56] References Cited

U.S. PATENT DOCUMENTS

| | | | |
|---|---|---|---|
| 2,307,729 | 1/1943 | Foster | 166/299 X |
| 2,616,370 | 11/1952 | Foster | 175/4.6 X |
| 2,837,027 | 6/1958 | Martin | 175/4.6 |
| 2,867,172 | 1/1959 | Hradel | 166/299 X |
| 2,988,143 | 6/1961 | Scotty | 166/299 |
| 5,014,788 | 5/1991 | Puri et al. | 166/308 |
| 5,417,286 | 5/1995 | Palmer et al. | 166/308 |

OTHER PUBLICATIONS

SPE 24906 "Openhole Cavity Completions in Coalbed Methane Wells in the San Juan Basin" I.D. Palmer, M.J. Mavor, J.P. Seidle, J.L. Spitler and R.F. Volz.

"The Technical Review–Perforating", vol. 34, No. 2 Jul. 1986.

"An Introduction to Perforating", C.M. Hightower, P.E., ARCO Exploration and Production Technology.

*Primary Examiner*—David J. Bagnell

*Attorney, Agent, or Firm*—F. Lindsey Scott

[57] ABSTRACT

A method for completing a well penetrating a solid carbonaceous subterranean formation by positioning a perforating gun in an uncased portion of a wellbore penetrating the solid carbonaceous subterranean formation; perforating the coal formation; and, producing fluids and particulate coal from the coal formation through the well to form a cavity in the coal formation surrounding the well.

14 Claims, 3 Drawing Sheets

METHOD FOR COMPLETING A WELL IN A COAL FORMATION

BACKGROUND OF THE INVENTION

1. Field of the Invention

This invention relates to the completion of a well penetrating a subterranean coal formation for the production of methane from the coal formation.

2. Description of the Prior Art

Solid carbonaceous subterranean formations such as coal formations contain significant quantities of natural gas. This natural gas is composed primarily of methane. The majority of the methane is sorbed onto the carbonaceous matrix of the formation and must be desorbed from the matrix and transferred to a wellbore in order to be recovered. The rate of recovery at the wellbore typically depends on the gas flow through the solid carbonaceous subterranean formation. The gas flow rate through the formation is affected by many factors including the matrix porosity of the formation, the system of fractures within the formation and the stress within the carbonaceous matrix which comprises the formation.

An unstimulated solid carbonaceous subterranean formation has a natural system of fractures, the smaller and more common ones being referred to as cleats or collectively as a cleat system. To reach the wellbore the methane must desorb from a sorption site within the matrix and diffuse through the matrix to the cleat system. The methane then passes through the cleat system to the wellbore.

The cleat system communicating with a production well often does not provide for an acceptable methane recovery rate. In general, solid carbonaceous formations require stimulation to enhance the recovery of methane from the formation. Various techniques have been developed to stimulate solid carbonaceous subterranean formations and thereby enhance the rate of methane recovery from these formations. These techniques typically attempt to enhance the desorbtion of methane from the carbonaceous matrix of the formation and enhance the permeability of the formation.

One example of a technique for stimulating the production of methane from a solid carbonaceous subterranean formation is to complete the production wellbores with an open-hole cavity. First a wellbore is drilled to a location above the solid carbonaceous subterranean formation. The wellbore may then be cased with the casing being cemented in place using a conventional drilling rig. A modified drilling rig is then used to drill an open hole interval within the formation. An "open-hole" interval is an interval within the solid carbonaceous subterranean formation which is not cased. The open-hole interval can be completed by various methods. One method utilizes an injection/blow down cycle to create a cavity within the open-hole interval. In this method air is injected into the open hole interval and then released rapidly through a surface valve causing the gas flow shear stress to overcome the rock strength in the wellbore wall. The procedure is repeated until a suitable cavity has been created. During the procedure a small amount of water can be added to selected air injections to reduce the potential for spontaneous combustion of the carbonaceous material in the formation and the like.

Techniques such as described above are considered to be known to the art and have been disclosed in U.S. Pat. No. 5,417,286 issued May 23, 1995 to Ian D. Palmer and Dan Yee and assigned to Amoco Corporation. This patent is hereby incorporated in its entirety by reference.

The use of such completions is further described in SPE 24906 "Open Hole Cavity Completions in Coalbed Methane Wells in the San Juan Basin", presented Oct. 4–7, 1992 by I. D. Palmer, M. J. Mavor, J. P. Seidle, J. L. Spitler and R. F. Volz.

The use of cavitated completions has been found to be much more effective than the use of cased wells perforated in the solid carbonaceous subterranean formation even when fracturing or other types of cased well completions are used. When the coal in the formation surrounding the wellbore in the uncased well has insufficient strength to resist movement of coal particles into the wellbore upon the production of fluids from the coal formation, the cavity can be formed by techniques such as discussed above. Unfortunately, in some instances, the formation of cavities is not readily accomplished by the production of fluids from the wellbore. Although the formations in such instances may not have great strength, they have sufficient strength to resist the movement of coal particles into the wellbore upon the production of fluids from the coal formation. In such instances it has been found difficult to initiate and complete the formation of cavities in the coal formations.

Since the use of cavities with such wells has been found to be much more effective for the production of methane than other techniques, a continuing effort has been directed to the development of an improved method for the completion of cavitated wells in such formations.

SUMMARY OF THE INVENTION

It has now been found that wells can be completed in such formations by a method comprising positioning a perforating gun in an uncased portion of the well penetrating the coal formation, perforating the coal formation and thereafter producing fluids and particulate coal from the coal formation through the well thereby forming a cavity in the coal formation around the well.

DESCRIPTION OF THE PREFERRED EMBODIMENTS

In the discussion of the Figures the same numbers will be used throughout to refer to same or similar components. Further, the term "coal formation" will be used to refer to solid carbonaceous subterranean formations such as brown coal, lignite, sub-bituminous coal, bituminous coal, anthracite coal and the like.

Figure 1:
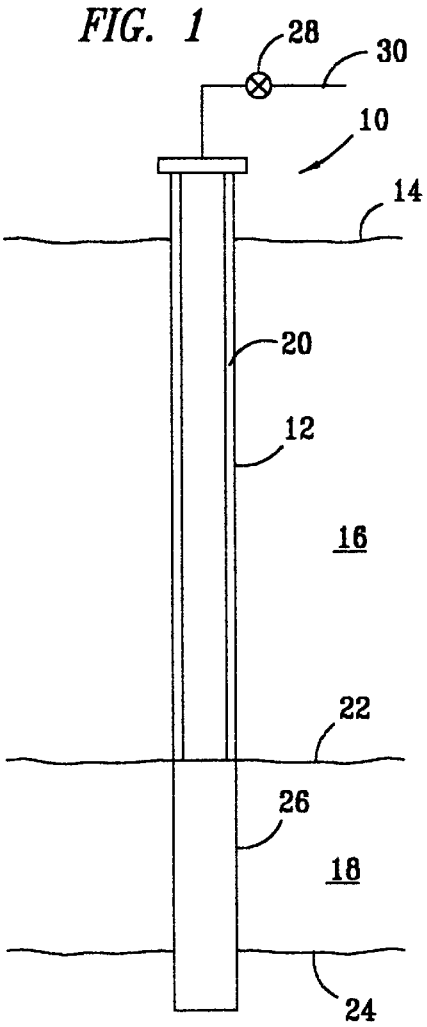
FIG. 1 is a schematic diagram of a well positioned to penetrate a subterranean coal formation wherein the well has been cased to the top of the coal formation.

In FIG. 1, a well 10 comprising a wellbore 12 is positioned from a surface 14 through an overburden 16 to penetrate a coal formation 18. As shown, wellbore 12 extends from surface 14 through coal formation 18 although it is not necessary that the wellbore extend through the coal formation. Well 10 has been cased with a casing 20 which is normally cemented in place by techniques known to those skilled in the art and extends from the surface 14 to near a top 22 of coal formation 18.

An uncased wellbore section 26 extends through coal formation 18 and to a bottom 24 of coal formation 18 as shown. FIG. 1 is a typical well completion for the production of methane from a coal formation prior to any stimulation of the coal formation.

Well 10 also includes a wellhead to control the flow of fluids into and from wellbore 12. The wellhead is shown schematically as a valve 28 and a flow line 30. Such wellheads are considered to be known to those skilled in the art and no further description is considered necessary.

Figure 2:
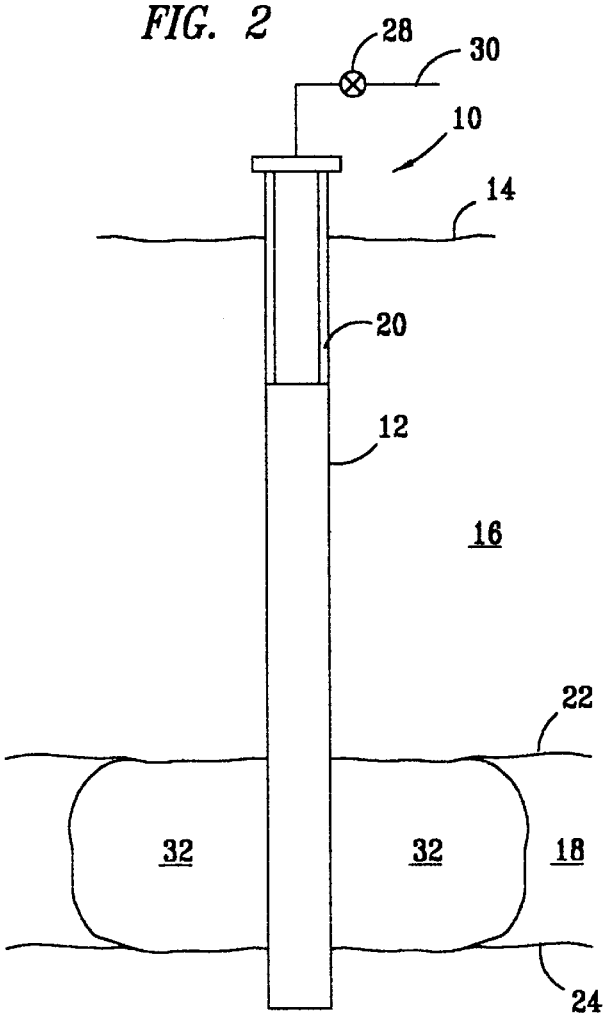
FIG. 2 is a schematic diagram of a well which has been cased only to a depth sufficient to enable the use of a wellhead for well control and which includes a cavity formed around the wellbore in the coal formation.

In FIG. 2 a similar well is shown except that casing 20 has only been positioned to a depth necessary to enable the installation of a wellhead for the control of the flow of fluids into and from wellbore 12. Further, the uncased portion 26 of wellbore 10 in FIG. 2 has been stimulated to form a cavity 32 which extends outwardly from wellbore 12 into coal formation 18.

As discussed above, such cavities can be formed by techniques such as closing in the well, allowing the pressure in the wellbore to increase to the pressure generated by the subterranean formation and thereafter opening the well and permitting the rapid flow of fluids and particulate coal from coal seam 18 into the wellbore and upwardly out of the wellbore. In many instances, such a treatment is sufficient to form cavity 32. In other instances, it may be necessary to periodically pass a bit downwardly through wellbore 12 to circulate and help remove particulate matter from the wellbore.

Alternatively, fluids may be injected into well 10 until a desired pressure is achieved in the well and thereafter allowed to flow rapidly back out of formation 18 and well 10 to remove particulate coal from coal formation 18 to form cavity 32. Such techniques are considered to be well known to those skilled in the art.

Unfortunately, such techniques do not work in all instances because even through the coal formation may be comprised of relatively weak coal particles, the particles may not move into the wellbore upon the production of fluids from the coal formation. This can pose considerable difficulty and result in considerable delay in forming a cavity surrounding an uncased wellbore penetrating a subterranean coal formation.

Figure 3:
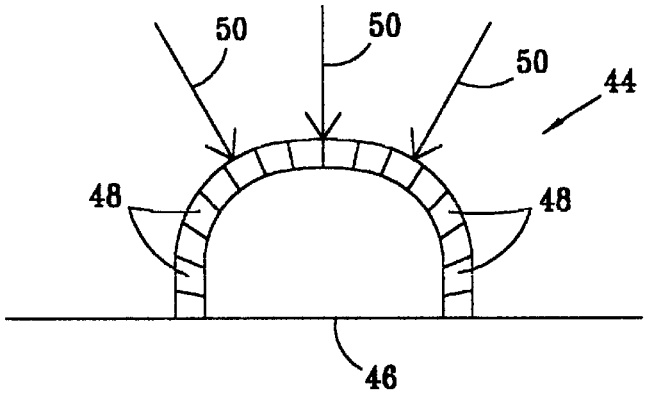
FIG. 3 shows an arch formed of particulate sections which is subjected to downwardly directed vertical forces.

The coal particles in such subterranean formations are generally subjected to compressive forces from three directions. The compressive forces are imposed by the overburden which imposes a vertical compressive force and horizontal forces which represent formation confining forces. These stresses resolve themselve into ring stresses around a wellbore if one is present. The effect of these forces on a given coal particle near the circumference of a wellbore can be considered by comparison to an arch structure 44 as shown in FIG. 3. Such an arch has a strength which is limited only by the compressive strength of the sections 48 which make up the arch. In other words, an arch as shown in FIG. 3 made up of a plurality of shaped sections 48 and positioned on a base 46 has a compressive strength under a load shown by arrows 50 determined by the crush strength of sections 48. The sections are held in place by the imposed forces and form a structure of great strength.

Figure 4:
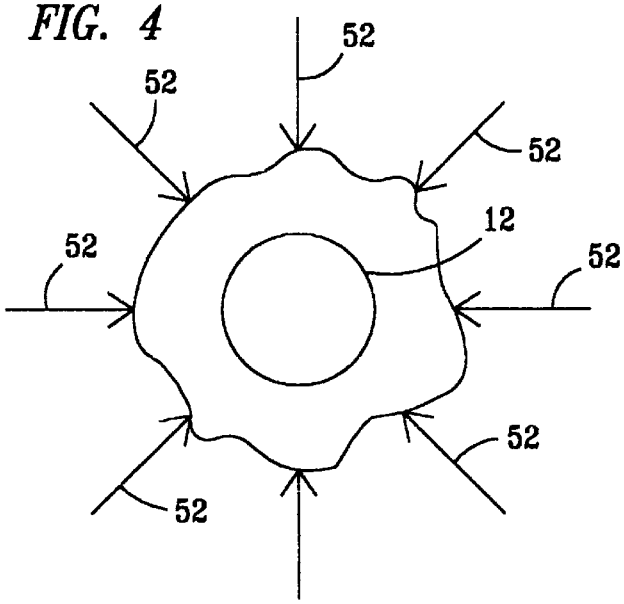
FIG. 4 is a cross-sectional view of a wellbore penetrating a subterranean coal formation showing horizontal forces imposed on the coal surrounding the wellbore.

By comparison, when the coal and possibly other particles comprising the coal formation surrounding wellbore are subjected to the horizontal forces imposed by the formation a similarly stable configuration results. In other words, the forces imposed tend to retain the particles in place around the wellbore since the imposition of forces about the circumference of a circle results in a similar effect to that produced by imposition of a vertically downward force on an arch. Such a force arrangement is shown in FIG. 4. The forces imposed by the horizontal forces (arrows 52) in coal formation 18 on the coal around wellbore 12 are imposed from all directions and result in maintaining the coal particles surrounding wellbore 12 in position since each of the particles is subjected to forces which hold it in position as a result of the forces in coal formation 18. Unless at least a portion of the particles can be removed a very strong structure is formed surrounding wellbore 12 which is limited only by the crushing strength of the individual particles. To remove the coal from such a structure requires that at least a portion of the particles be removed to initiate a collapse of the coal formation structure surrounding wellbore 12. This may be achieved in some wells by simply producing fluids from the formation when the formation particles are sufficiently weak to collapse under the compressive stresses at the outer diameter of wellbore 12. Unfortunately, in some instances, the coal formation particles are not sufficiently weak to collapse upon the production of fluids from the formation. As a result, such formations do not cavitate upon the production of fluids from the formation and it is difficult to form a cavity in such subterranean formations by the production of fluids from the formation as practiced previously.

It has now been found that cavitation can be initiated in such uncased wells by the use of a perforating gun. Perforating guns are typically used in the oil industry to form holes through a casing in a formation of interest. Formations have also been fractured from perforated wells in attempts to increase methane production from such wells. Formations penetrated by perforated cased wells have also been fractured in attempts to increase methane production from such wells. It has now been found that perforating guns can be used in uncased wells in formations which do not readily cavitate upon the production of fluids from the formation to initiate cavitation by forming openings (perforations) extending outwardly from the circumference of wellbore 12. The perforating guns do not leave substantial residual material in the wellbore and can form perforations extending up to at least two feet into the coal formation. These perforations function to create "gaps" in the circle structure of the wellbore which weaken the well wall and permit particles to move into the wellbore with fluids produced from the formation.

Figure 5:
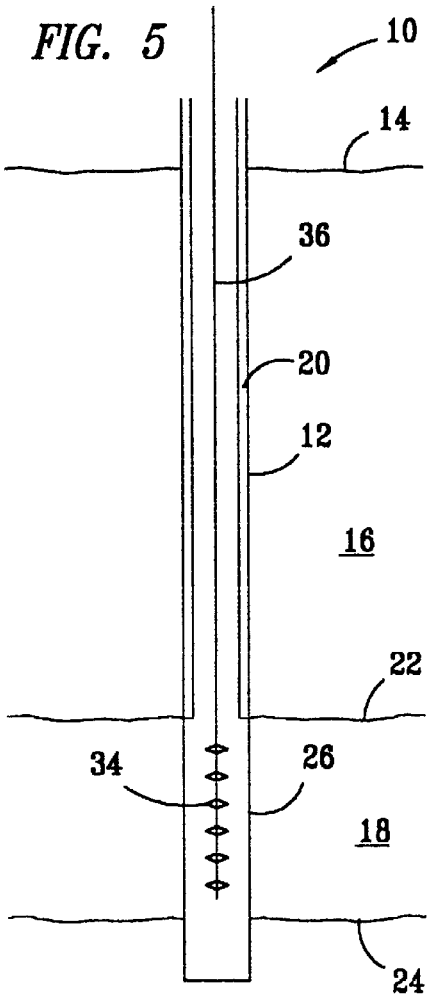
FIG. 5 is a schematic diagram of a well which has been cased to the top of a coal formation wherein a wireline perforating gun has been positioned in an uncased portion of the wellbore extending through the coal formation.

Such an embodiment is shown in FIG. 5 where a well is shown with a perforating gun 34 positioned to form perforations along the length of an uncased wellbore section 26 in a coal formation 18. After perforation of the coal formation, cavitation can be accomplished by the steps discussed above for wells from which coal particles flow into wellbore 12 without the use of perforation.

Figure 6:
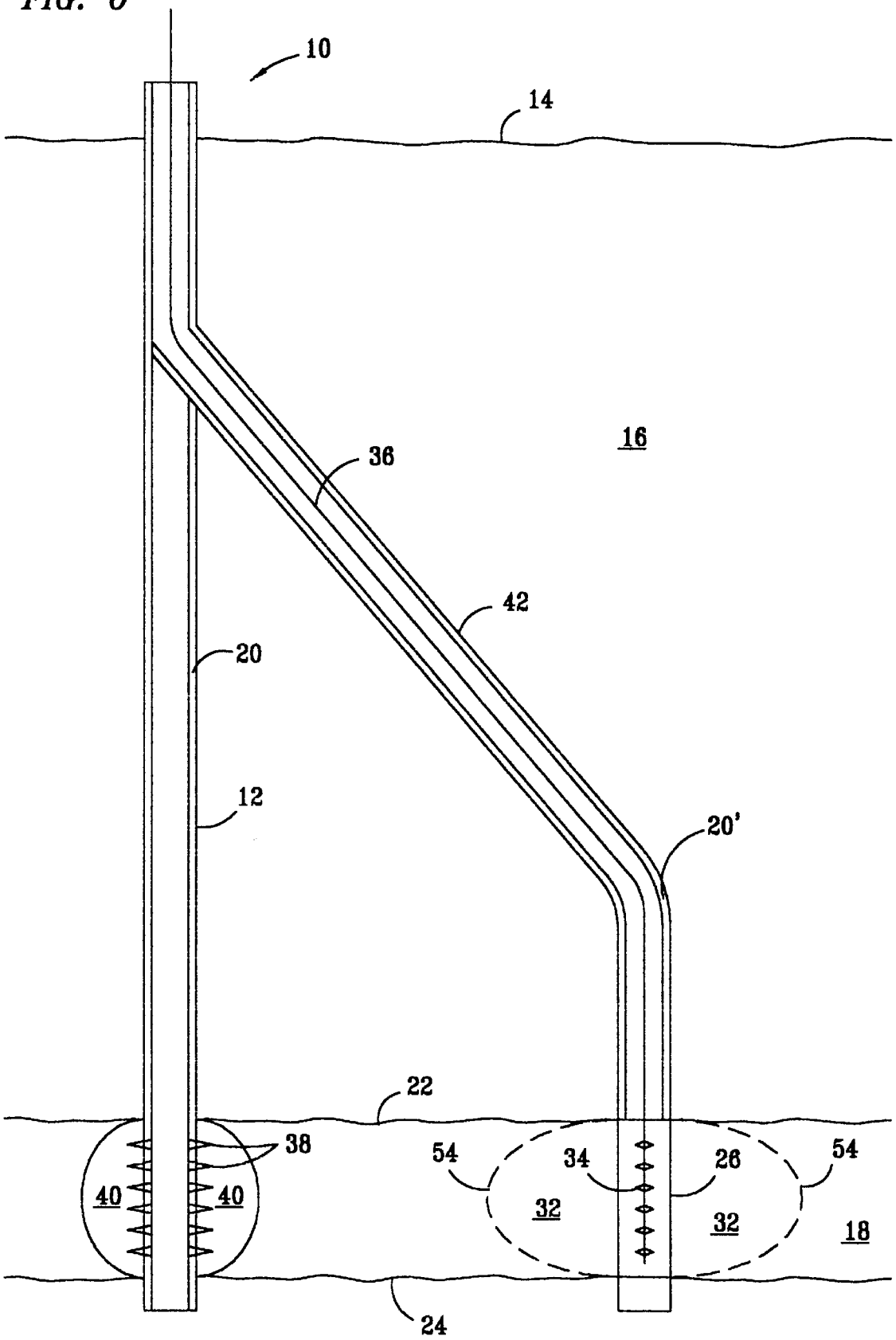
FIG. 6 is a schematic diagram of a well which has been cased through a coal seam and subsequently perforated and fractured and which has been sidetracked to penetrate the coal formation at a different location.

In a further embodiment shown in FIG. 6 a wellbore 12 which has been cased through a coal formation, perforated and fractured is shown. Wellbore 12 as initially completed was perforated at perforations 38 and fractured to create a fracture zone 40 in coal formation 18. This well was then abandoned and sidetracked by drilling a sidetracked wellbore 42 as known to those skilled in the art to penetrate coal formation 18 at a second location. A casing 20' extends to the top of coal formation 18 in sidetracked wellbore 42. A perforating gun 34 is shown positioned in an uncased section 26 of sidetracked wellbore 42 to perforate coal formation 18 in uncased section 26. After perforation fluids will be produced from coal formation 18 in a repeating cycle as discussed previously to form a cavity 32 shown by dotted lines 54.

As previously discussed wellbores can be cavitated simply by closing the well and allowing the pressure to build to a selected pressure or to the maximum pressure resulting from the natural formation pressure and then opened and allowed to rapidly blow down to a selected pressure or a steady state pressure. Frequently, liquids, gases and particulate solids will be produced from wellbores by this technique. Repeated cycles are typically used to produce cavities of a desired size. It is also common to use a drill bit to re-enter such wellbores to remove particulate coal solids from the wellbore one or more times during the course of the formation of the cavity. Repeated cycles are typically used to form the cavities.

Cavities may also be formed by injecting gas or mixtures of gas and liquids into the coal formation through the wellbore until a desired pressure is achieved. The well is then allowed to rapidly blow down with the fluids from the coal formation causing the flow of coal particulates into the wellbore and typically up the wellbore for production as the pressure is reduced. Repeated cycles are typically used to form cavities. It may also be necessary in this embodiment to use a drill bit to remove coal particles from the wellbore periodically.

Such completions are well known to those skilled in the art.

By the method of the present invention cavitation is induced in wells which do not cavitate using conventional methods. By the present invention a simple method has been provided for initiating cavitation in wells which are resistant to cavitation. This improvement permits the cavitation of wells for the production of increased quantities of methane, economically and efficiently, using equipment which is readily available to the industry.

Such perforating guns are well known to those skilled in the art, "The Technical Review" published by Schlumberger Ltd., July 1986 describes the development and current use of perforating guns in the oil industry.

Having thus described the present invention by reference to its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention I claim:

1. A method for completing a cavitated well penetrating a subterranean coal formation, the method consisting essentially of:

a) positioning a perforating gun in an uncased portion of a well penetrating the coal formation;

b) perforating the coal formation; and, c) forming a cavity in the coal formation by producing fluids and particulate coal from the coal formation through the well.

2. The method of claim 1 wherein the perforating gun is a tubing conveyed perforating gun.

3. The method of claim 1 wherein the perforating gun is a wireline conveyed perforating gun.

4. The method of claim 1 wherein the well is cased from a surface to near the top of the coal formation.

5. The method of claim 1 wherein the coal formation is perforated at a plurality of locations by the perforating gun.

6. The method of claim 1 wherein the fluids and particulate coal are produced from the well by shutting in the well for a shut-in period to permit the pressure in the well to increase and thereafter opening the well for a production period to permit a flow of fluids and particulate coal from the coal formation into, upwardly through and out of the well.

7. The method of claim 6 wherein the flow of fluids moves particulate coal into the well.

8. The method of claim 7 wherein a plurality of shut-in periods and production periods are used to form the cavity.

9. The method of claim 1 wherein a fluid is injected into the coal formation during an injection period to increase the pressure in the coal formation around the well and thereafter the well is opened for a production period to permit a flow of fluids and particulate coal from the coal formation into, upwardly through and out of the well.

10. The method of claim 9 wherein the flow of fluids moves particulate coal into the well.

11. The method of claim 10 wherein a plurality of injection periods and production periods are used to form the cavity.

12. The method of claim 1 wherein the perforating gun discharges a projectile into the coal formation.

13. The method of claim 1 wherein the perforating gun utilizes shaped charges.

14. The method of claim 1 wherein the coal formation is perforated to a depth of about two feet.

* * * * *